US011745073B2

(12) United States Patent
Chen

(10) Patent No.: US 11,745,073 B2
(45) Date of Patent: Sep. 5, 2023

(54) PUNCHING-TRAINING DEVICE

(71) Applicant: Pang Mei Sport Co., Ltd., Changhua County (TW)

(72) Inventor: Chih-Lung Chen, Changhua County (TW)

(73) Assignee: PANG MEI SPORT CO., LTD., Changhua County (TW)

( * ) Notice: Subject to any disclaimer, the term of this patent is extended or adjusted under 35 U.S.C. 154(b) by 102 days.

(21) Appl. No.: 17/372,883

(22) Filed: Jul. 12, 2021

(65) Prior Publication Data

US 2023/0010539 A1 Jan. 12, 2023

(51) Int. Cl.
*A63B 69/22* (2006.01)
*A63B 69/24* (2006.01)

(52) U.S. Cl.
CPC ..... *A63B 69/224* (2022.08); *A63B 69/22* (2022.08); *A63B 69/24* (2013.01); *A63B 2225/093* (2013.01)

(58) Field of Classification Search
CPC ..... A63B 69/22; A63B 69/224; A63B 69/20; A63B 69/203; A63B 69/205; A63B 69/24; A63B 69/244; A63B 2225/093
See application file for complete search history.

(56) References Cited

U.S. PATENT DOCUMENTS 3,022,072 A * 2/1962 Zinnow ..... A63B 69/224 446/490
7,651,447 B2 * 1/2010 Yang ..... A63B 69/0075 482/85
8,641,583 B2 * 2/2014 Chen ..... A63B 69/20 482/90
11,471,739 B2 * 10/2022 Wu ..... A63B 69/004
2015/0182833 A1 * 7/2015 Hu ..... A63B 69/224 482/87
2020/0155914 A1 * 5/2020 Hu ..... A63B 69/203

* cited by examiner

*Primary Examiner* — Megan Anderson
(74) *Attorney, Agent, or Firm* — MUNCY, GEISSLER, OLDS & LOWE, P.C.

(57) ABSTRACT

A punching-training device is provided, including: a seat portion; a support portion, connected with the seat portion; a punched portion, connected with the support portion; and an elastic assembly, disposed on the support portion, the elastic assembly including a first elastic member and a second elastic member, at least one of the first elastic member and the second elastic member being movably relative to the support portion between a first position and a second position to change a relative position of the first elastic member and the second elastic member.

8 Claims, 7 Drawing Sheets

PUNCHING-TRAINING DEVICE

BACKGROUND OF THE INVENTION

Field of the Invention

The present invention relates to a punching-training device.

Description of the Prior Art

Conventionally, a punching-training device has a target for a user to practice striking skills.

The structure of the conventional punching-training device includes a seat with a fixed weight and a rod mounted on the seat. A hitting piece is mounted to an end of the rod, and an elastic member is connected between the seat and the rod so that the hitting piece can elastically swing. However, the elastic member of the conventional punching-training device has a fixed coefficient of elasticity, which results in the same swing amplitude and frequency after hitting, thus resulting in low flexibility in hitting practice due to the fixed coefficient of elasticity which is not adjustable.

The present invention is, therefore, arisen to obviate or at least mitigate the above-mentioned disadvantages.

SUMMARY OF THE INVENTION

The main object of the present invention is to provide a punching-training device which has an adjustable coefficient of elasticity so that the swing amplitude and frequency can be adjusted according to various practice requirements.

To achieve the above and other objects, a punching-training device is provided, including: a seat portion; a support portion, connected with the seat portion; a punched portion, connected with the support portion; and an elastic assembly, disposed on the support portion, the elastic assembly including a first elastic member and a second elastic member, at least one of the first elastic member and the second elastic member being movably relative to the support portion between a first position and a second position to change a relative position of the first elastic member and the second elastic member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
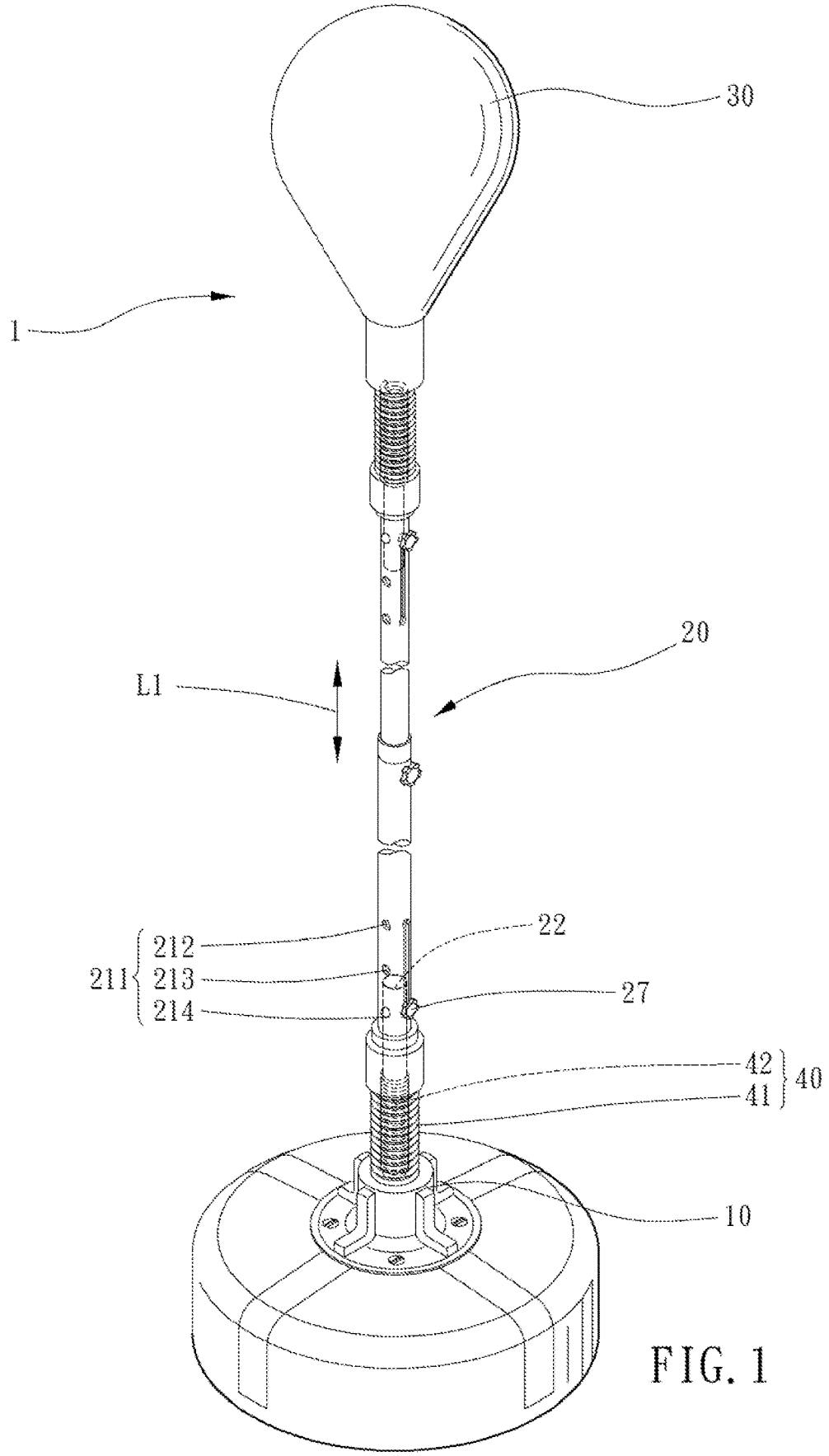
FIG. 1 is a stereogram of a first preferable embodiment of the present invention.
Figure 2:
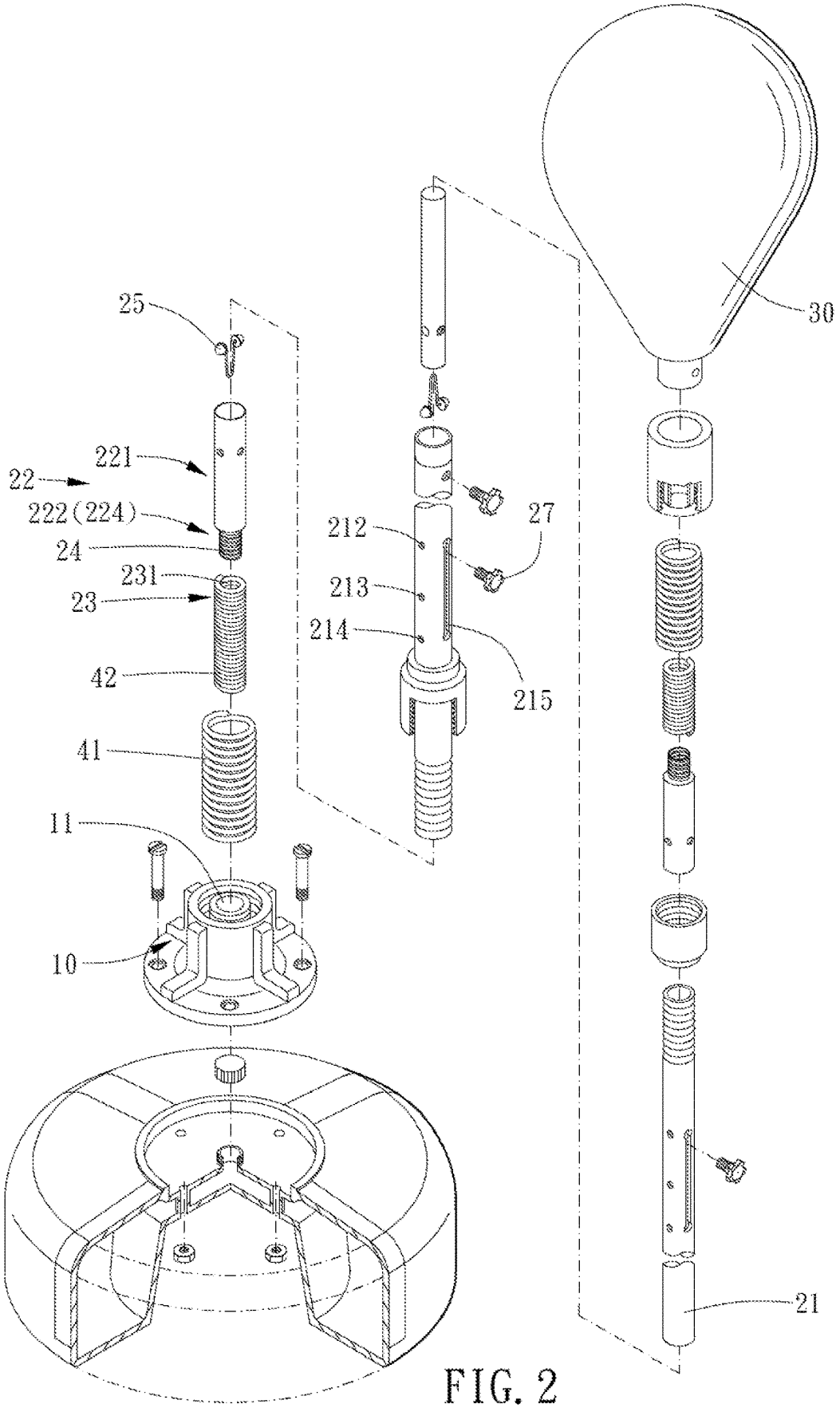
FIG. 2 is a breakdown drawing of the first preferable embodiment of the present invention.
Figure 3:
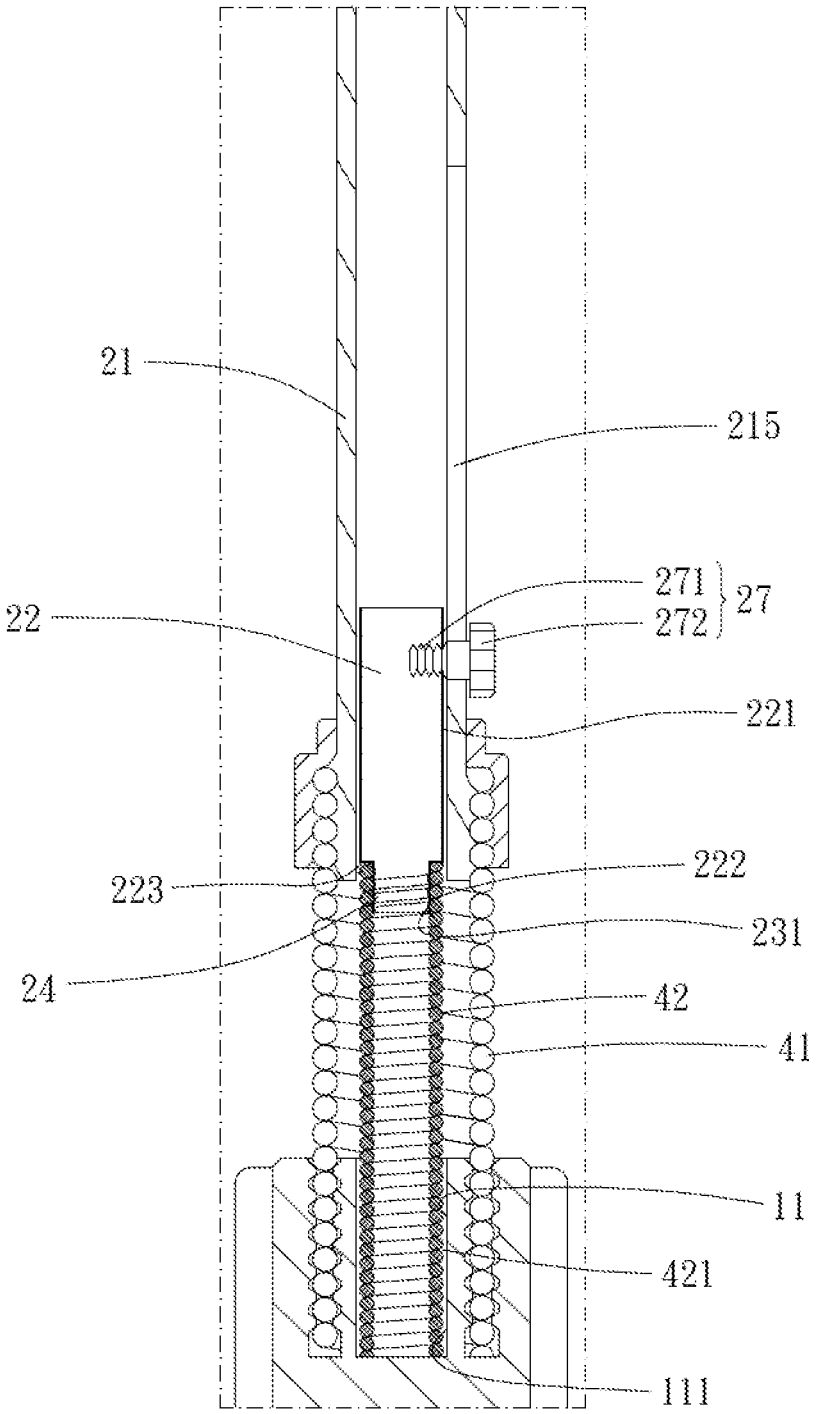
FIG. 3 is a cross-sectional view showing a first operational state of the first preferable embodiment of the present invention.
Figure 4:
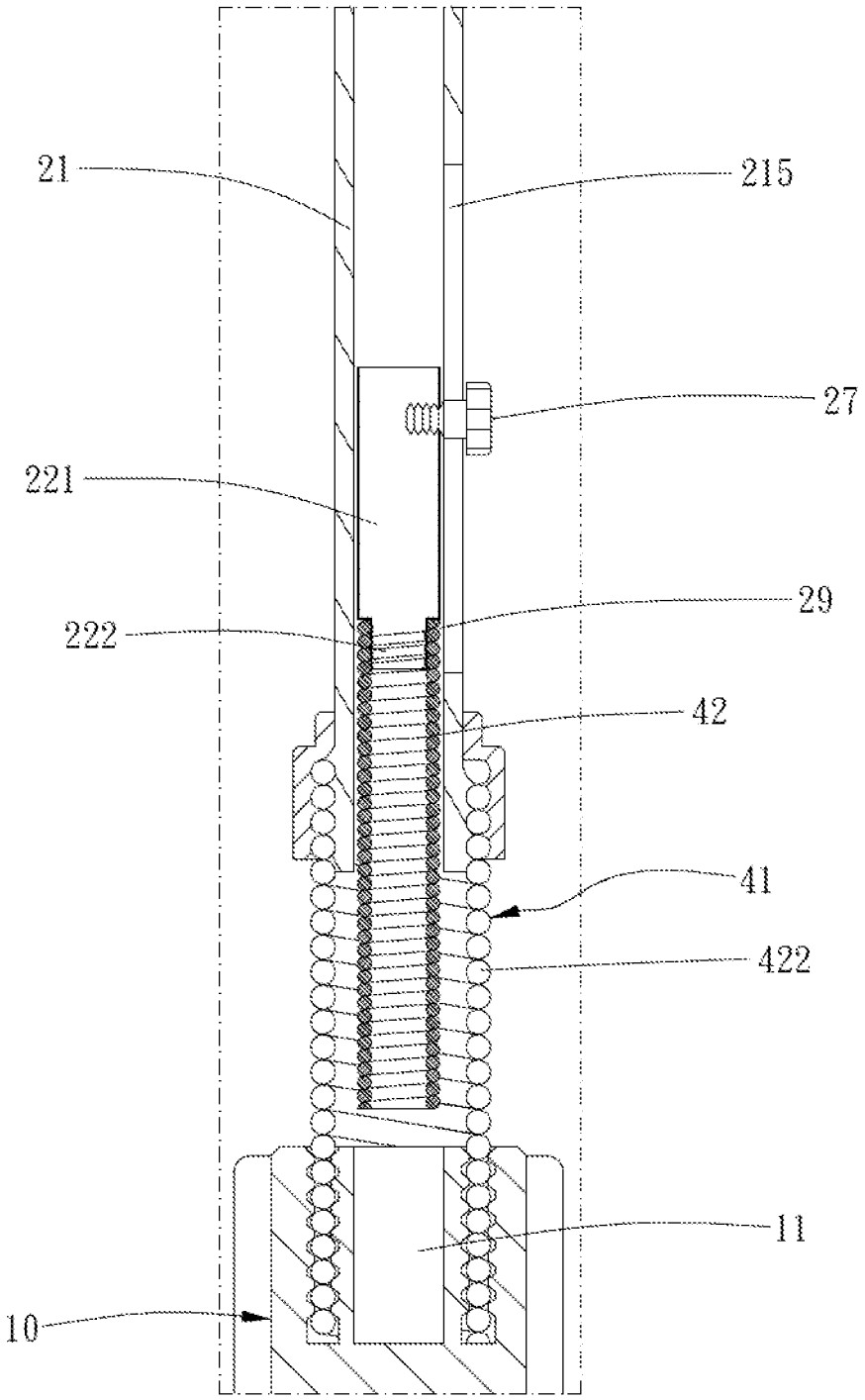
FIG. 4 is a cross-sectional view showing a second operational state of the first preferable embodiment of the present invention.
Figure 5:
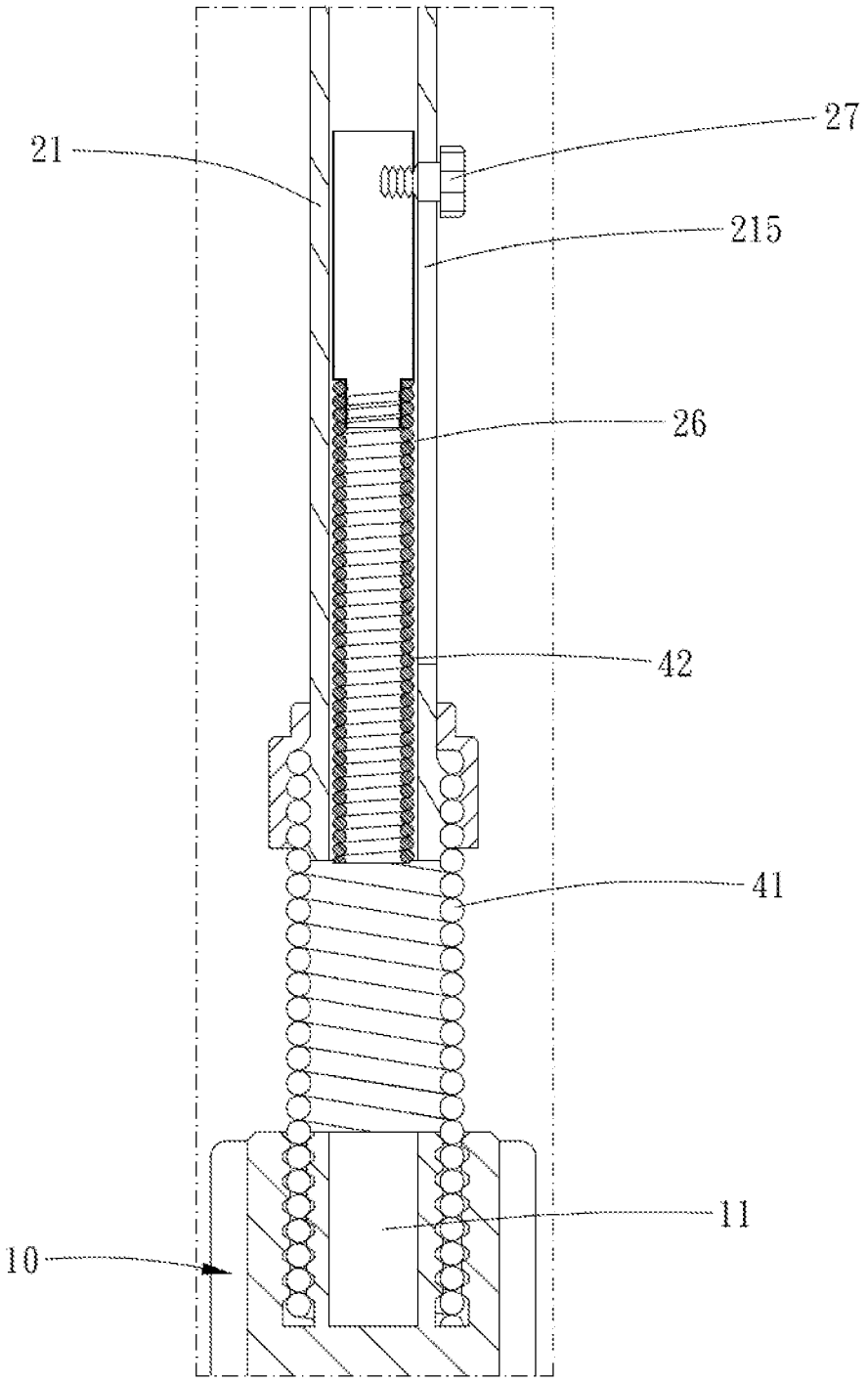
FIG. 5 is a cross-sectional view showing a third operational state of the first preferable embodiment of the present invention.

Please refer to FIGS. 1 to 5 for a preferable embodiment of the present invention. A punching-training device 1 includes a seat portion 10, a support portion 20, a punched portion 30 and an elastic assembly 40.

The support portion 20 is connected with the seat portion 10; the punched portion 30 is connected with the support portion 20; the elastic assembly 40 is disposed on the support portion 20, the elastic assembly 40 includes a first elastic member 41 and a second elastic member 42, at least one of the first elastic member 41 and the second elastic member 42 is movably relative to the support portion between a first position and a second position to change a relative position of the first elastic member 41 and the second elastic member 42. Specifically, the second elastic member 42 includes a buffering portion 422 which does not overlap radially with the support portion 20 and the seat portion 10 so that the second elastic member 42 is optional to be located outside the buffering portion 422 (without overlapping radially with the buffering portion), or the second elastic member 42 and the buffering portion 422 can be sleeved with each other and the overlapping range of the second elastic member 42 and the buffering portion can be changed through relative movement; however, the second elastic member may not overlap with the first elastic member. Whereby, the coefficient of elasticity of the elastic assembly 40 is adjustable so that the swinging range, buffering effect and position-recovering time of the punching-training device can be adjusted. The elastic assembly 40 may be disposed between the support portion 20 and the seat portion 10, or between the punched portion 30 and the support portion 20. In addition, the punching-training device may include a plurality of elastic assemblies 40 which are respectively disposed between the support portion 20 and the seat portion 10 and disposed between the punched portion 30 and the support portion 20.

The support portion 20 includes a rod body 21 and a driving member 22 movably connected to the rod body 21. In this embodiment, the rod body 21 is a tubular member, the driving member 22 is inserted in the rod body 21, and at least one of the first elastic member 41 and the second elastic member 42 is inserted within the driving member 22. In this embodiment, the driving member 22 includes a connection portion 224, one of the first elastic member 41 and the second elastic member 42 includes an assembling portion 23, and the assembling portion 23 is detachably disposed around the connection portion 224. The connection portion 224 includes an outer threaded section 24, the assembling portion 23 includes an inner threaded section 231 corresponding to the outer threaded section 24, and the outer threaded section 24 and the inner threaded section 231 are screwed with each other so that it is easy and quick to assembly/disassembly and to adjust the position of the first elastic member 41 or the second elastic member 42 relative to the driving member 22. In this embodiment, the second elastic member 42 is disposed on the driving member 22 and includes the assembling portion 23, and the first elastic member 41 is disposed on the rod body 21.

The driving member 22 is rod-shaped, the driving member 22 includes an enlarged section 221 and a narrowed section 222 connected with the enlarged section 221, and one of the first elastic member 41 and the second elastic member 42 is disposed around the narrowed section 222. Preferably, the driving member 22 further includes a shoulder 223 between the enlarged section 221 and the narrowed section 222, and one of the first elastic member 41 and the second elastic member 42 is abutted against the shoulder 223. In this embodiment, the second elastic member 42 is disposed around the narrowed section 222 and abutted axially against the shoulder 223 in a first direction L1. Preferably, the enlarged section 221 has a longitudinal dimension greater than a longitudinal dimension of the narrowed section 222, which provides good support so that the second elastic member 42 is uneasy to disengage from the driving member 22. Specifically, the shoulder 223 stably supports the assembling portion 23 of the second elastic member 42 so as to prevent the disengagement of the assembling portion 23 of the second elastic member 42.

The rod body 21 includes a positioning portion 211, the support portion 20 further includes a positioning member 25 disposed on the enlarged section 221. In this embodiment, the driving member 22 is a tubular member, the positioning member 25 may be disposed in the driving member 22, and the positioning member 25 and the positioning portion 211 are releasably positioned with each other. The positioning portion 211 includes a first through hole 212, a second through hole 213 and a third through hole 214, and the driving member 22 is movable in the first direction L1 relative to the rod body 21. The first through hole 212, the second through hole 213 and the third through hole 214 are arranged along the first direction L1. The positioning member 25 is an elastic detent mechanism such as a V-shaped spring. The positioning member 25 is engaged within one of the first through hole 212, the second through hole 213 and the third through hole 214. When the positioning member 25 is engaged within the first through hole 212, the second elastic member 42 is non-protrusive beyond the rod body 21 in the first direction L1; when the positioning member 25 is engaged within the second through hole 213, the second elastic member 42 is protrusive beyond the rod body 21 in the first direction L1, and the first elastic member 41 and the second elastic member 42 overlap radially with each other to define a first overlapping range; when the positioning member 25 is engaged within the third through hole 214, the second elastic member 42 is protrusive beyond the rod body 21 in the first direction L1, and the first elastic member 41 and the second elastic member 42 overlap radially with each other to define a second overlapping range, wherein the first overlapping range and the second overlapping range have different ranges. Whereby, the coefficient of elasticity of the elastic assembly 40 can be adjusted according various requirements.

The first elastic member 41 is a hollow member such as a coil spring or compression spring, and the first elastic member 41 has an outer diametric dimension greater than an outer diametric dimension of the second elastic member 42. The second elastic member 42 is detachably inserted within the first elastic member 41, and the first elastic member 41 and the second elastic member 42 are radially gapped so that the first elastic member 41 and the second elastic member 42 is uneasy to interfere with each other during swinging. In the first direction, the second elastic member 42 has a longitudinal dimension greater than two times a longitudinal dimension of the connection portion 224 so that the second elastic member 42 is stably connected and swingable for a large range. The driving member 22 is rigid (for example, made of metal). The second elastic member 42 may be a spring such as compression spring.

The rod body 21 is a tubular member, at least one of the first elastic member 41 and the second elastic member 42 is inserted within the tubular member, and there is a gap 26 between the tubular member (rod body 21) and at least one of the first elastic member 41 and the second elastic member 42, which is good in relative movement.

The seat portion 10 includes a receiving space 11, the second elastic member 42 is detachably inserted within the receiving space 11, and an outer circumferential face 421 of the second elastic member 42 and an inner circumferential face 111 of the receiving space 11 are gapped from each other so that the second elastic member 42 is smoothly movable in the receiving space 11.

The narrowed section 222 and the tubular member define a surrounding gap 29 therebetween, the second elastic member 42 is disposed in the tubular member and received within the surrounding gap 29 so that the second elastic member 42 can retract partially or entirely into the tubular member so as to make the second elastic member 42 non-overlapped radially with the buffering portion 422.

The driving member 22 disposed in the tubular member, the tubular member includes an elongated groove 215 disposed therethrough, the support portion 20 further includes an urging member 27, the urging member 27 includes an end portion 271 which is disposed through the elongated groove 215 and screwed to the driving member 22 and a control end portion 272 located outside the driving member 22, and the control end portion 272 is disengageably abutted radially against the tubular member to provide stepless adjustment and positioning.

Figure 6:
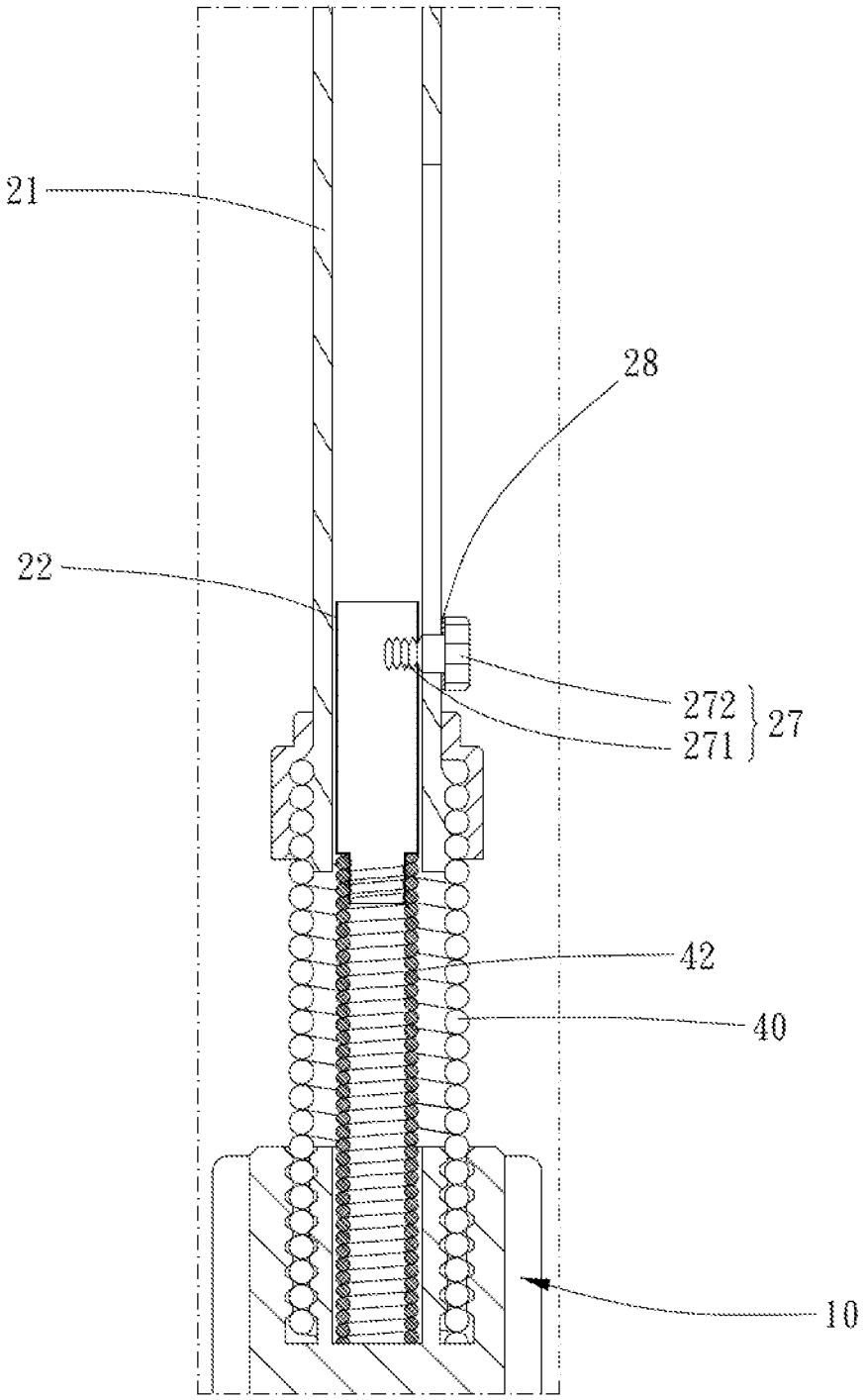
FIG. 6 is a cross-sectional view of a second preferable embodiment of the present invention.

Please refer to a second embodiment shown in FIG. 6. The support portion 20 further includes a washer 28. The washer 28 is disposed outside the rod body 21 and located between the rod body 21 and the control end portion 272, which enhances positioning effect.

Figure 7:
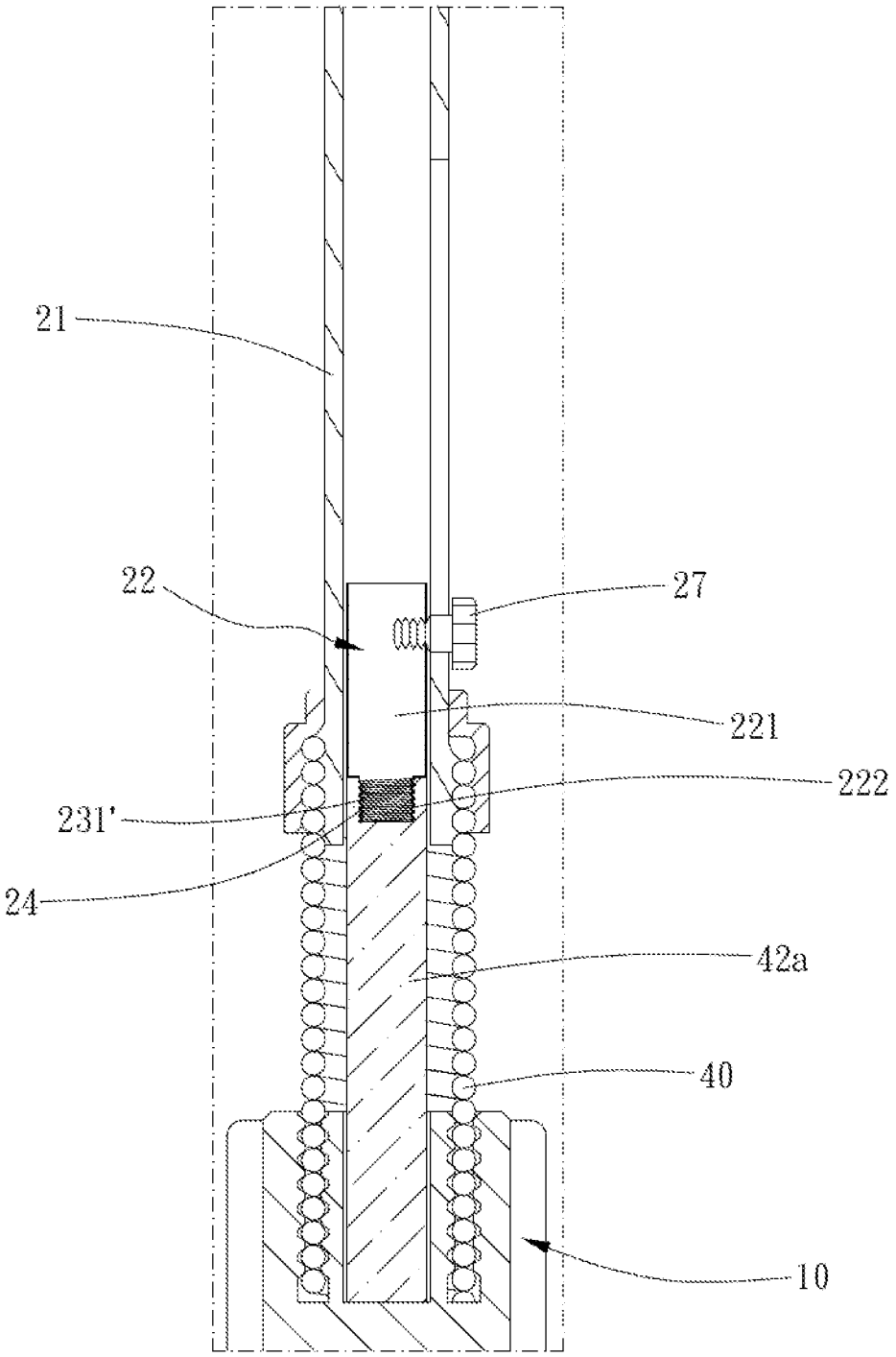
FIG. 7 is a cross-sectional view of a third preferable embodiment of the present invention.

Please refer to a third embodiment shown in FIG. 7. The second elastic member 42*a* may include at least one elastic strap, each of at least one the elastic strap is made of plastic material, rubber or elastic polymer, and the second elastic member 42*a* includes a recess having the inner threaded section 231'.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A punching-training device, including:

a seat portion;

a support portion, connected with the seat portion;

a punched portion; connected with the support portion; and an elastic assembly; disposed on the support portion, including a first elastic member and a second elastic member, at least one of the first elastic member and the second elastic member being movably relative to the support portion between a first position and a second position to change a relative position of the first elastic member and the second elastic member;

wherein the support portion includes a rod body and a driving member movably connected to the rod body, and one of the first elastic member and the second elastic member is connected with the driving member;

wherein the rod body includes a positioning portion, the positioning portion includes a first through hole, a second through hole and a third through hole, the driving member is movable in a first direction relative to the rod body, the first through hole, the second through hole and the third through hole are arranged along the first direction, the support portion further includes a positioning member, the positioning member is an elastic detent mechanism, and the positioning member is disengageably engaged within one on the first through hole, the second through hole and the third through hole; when the positioning member is engaged within the first through hole, the second elastic member is non-protrusive beyond the rod body in the first direction; when the positioning member is engaged within the second through hole, the second elastic member is protrusive beyond the rod body in the first direction, the first elastic member and the second elastic member overlap radially with each other to define a first overlapping range; when the positioning member is engaged within the third through hole, the second elastic member is protrusive beyond the rod body in the first direction, the first elastic member and the second elastic member overlap radially with each other to define a second overlapping range, and the first overlapping range and the second overlapping range have different ranges.

2. The punching-training device of claim 1, wherein the driving member is rod-shaped, the driving member includes an enlarged section and a narrowed section connected with the enlarged section, and one of the first elastic member and the second elastic member is disposed around the narrowed section.

3. The punching-training device of claim 2, wherein the driving member further includes a shoulder between the enlarged section and the narrowed section, and one of the first elastic member and the second elastic member is abutted against the shoulder.

4. The punching-training device of claim 2, wherein the positioning member is disposed on the enlarged section, and the positioning member and the positioning portion are disengageably positioned with each other.

5. The punching-training device of claim 1, wherein the driving member includes a connection portion, one of the first elastic member and the second elastic member includes an assembling portion, the assembling portion is detachably disposed around the connection portion, the connection portion includes an outer threaded section, the assembling portion includes an inner threaded section corresponding to the outer threaded section, and the outer threaded section and the inner threaded section are screwed with each other.

6. The punching-training device of claim 1, wherein the first elastic member is a hollow member, the first elastic member has an outer diametric dimension greater than an outer diametric dimension of the second elastic member, the second elastic member is detachably inserted within the first elastic member, and the first elastic member and the second elastic member are radially gapped.

7. The punching-training device of claim 1, wherein the rod body is a tubular member, at least one of the first elastic member and the second elastic member is placed around the tubular member, and there is a gap between the tubular member and the at least one of the first elastic member and the second elastic member.

8. The punching-training device of claim 1, wherein the driving member is rigid; the second elastic member is a spring or at least one elastic strap; the driving member includes a connection portion, one of the first elastic member and the second elastic member includes an assembling portion, the assembling portion is detachably disposed around the connection portion, the connection portion includes an outer threaded section, the assembling portion includes an inner threaded section corresponding to the outer threaded section, and the outer threaded section and the inner threaded section are screwed with each other; the driving member is a tubular member, the driving member includes an enlarged section and a narrowed section connected with the enlarged section, and one of the first elastic member and the second elastic member is disposed around the narrowed section; the enlarged section has a longitudinal dimension greater than a longitudinal dimension of the narrowed section; the driving member further includes a shoulder between the enlarged section and the narrowed section, one of the first elastic member and the second elastic member is abutted against the shoulder; the positioning member is disposed on the enlarged section; the first elastic member is a hollow member, the first elastic member has an outer diametric dimension greater than an outer diametric dimension of the second elastic member, the second elastic member is detachably inserted within the first elastic member, and the first elastic member and the second elastic member are radially gapped; the rod body is a tubular member, at least one of the first elastic member and the second elastic member is inserted within the tubular member, and there is a gap between the tubular member and the at least one of the first elastic member and the second elastic member; in the first direction, the second elastic member has a longitudinal dimension greater than two times a longitudinal dimension of the connection portion; the seat portion includes a receiving space, the second elastic member is detachably inserted within the receiving space, and an outer circumferential face of the second elastic member and an inner circumferential face of the receiving space are gapped from each other; the driving member is disposed in the tubular member, the tubular member includes an elongated groove disposed therethrough, the support portion further includes an urging member and a washer, the urging member includes an end portion which is disposed through the elongated groove and screwed to the driving member and a control end portion located outside the driving member, and the washer is disposed outside the rod body and located between the rod body and the control end portion; the narrowed section and the tubular member define a surrounding gap therebetween, and the second elastic member is disposed in the tubular member and received within the surrounding gap.

* * * * *